United States Patent [19]

Trotta

[11] Patent Number: 4,511,273

[45] Date of Patent: Apr. 16, 1985

[54] CORRECTION FLUID DISPENSER HAVING A RETRACTABLE AND LOCKABLE SEALING TIP

[75] Inventor: Robert A. Trotta, Pembroke, Mass.

[73] Assignee: The Gillette Company, Boston, Mass.

[21] Appl. No.: 561,135

[22] Filed: Dec. 13, 1983

Related U.S. Application Data

[63] Continuation-in-part of Ser. No. 425,199, Sep. 28, 1982, abandoned, which is a continuation-in-part of Ser. No. 319,245, Nov. 9, 1981, abandoned.

[51] Int. Cl.[3] ..... B43K 8/00; B43K 1/06

[52] U.S. Cl. ..... 401/260; 401/264

[58] Field of Search ..... 401/116, 258, 259, 260, 401/264, 277

[56] References Cited

U.S. PATENT DOCUMENTS

| | | | |
|---|---|---|---|
| 244,194 | 7/1881 | Cross | 401/260 |
| 2,149,711 | 3/1939 | Stock | 401/277 |
| 2,746,073 | 5/1956 | Harris | 401/264 |
| 3,561,881 | 2/1971 | Bok | 401/258 |
| 3,680,968 | 8/1972 | Schwartzman et al. | 401/260 |

FOREIGN PATENT DOCUMENTS

| | | | |
|---|---|---|---|
| 477244 | 9/1951 | Canada | 401/116 |
| 759950 | 5/1953 | Fed. Rep. of Germany | 401/260 |
| 976412 | 3/1951 | France | 401/116 |
| 322317 | 12/1929 | United Kingdom | 401/277 |
| 746815 | 3/1956 | United Kingdom | 401/264 |
| 806296 | 12/1958 | United Kingdom | 401/116 |
| 1437858 | 7/1974 | United Kingdom | 401/260 |

*Primary Examiner*—Steven A. Bratlie

*Attorney, Agent, or Firm*—Leonard J. Janowski

[57] ABSTRACT

A correction fluid dispenser comprising a body member adapted to retain correction fluid, a barrel member received by the body member, a core portion extending axially of the body and barrel members, and a tip seal member disposed in a recess in the core portion and spring biased toward an orifice in the barrel member to block the orifice and prevent flow of fluid therethrough, the tip seal member being retractable against the spring bias to permit fluid flow through the orifice, the body and barrel members being operable to move the core portion, and thereby the tip seal member, into the orifice in blocking, nonretractable position.

7 Claims, 8 Drawing Figures

CORRECTION FLUID DISPENSER HAVING A RETRACTABLE AND LOCKABLE SEALING TIP

This application is a continuation-in-part of presently pending application Ser. No. 425,199 filed Sept. 28. 1982 now abandoned, which is a continuation-in-part of abandoned application Ser. No. 319,245 filed Nov. 9, 1981.

BACKGROUND OF THE INVENTION

1. Field of the Invention

This invention relates to fluid dispensers and is directed more particularly to a correction fluid dispenser for correcting typewriter mistakes.

2. Description of the Prior Art

Correction of typing errors is frequently accomplished by an operator dabbing onto the typed page a white liquid substance by means of a brush taken from a bottle of the substance. Upon drying of the substance over the typing error, the correct typing entry is made on the dried layer of white substance, or correction fluid.

Correction fluid dispensers, of a pencil or pen type, have been used, but generally unsatisfactorily. Such devices usually have internally a spring-biased plunger which closes the discharge orifice of the device to prevent drying of the correction fluid reservoir. Pressure applied to the point of the device operates to push the plunger back into the device and clear off the discharge orifice to permit flow of correction fluid therethrough. A problem that has persisted lies in the fact that a forceful spring bias is required to maintain the plunger in an orifice-blocking position tight and secure enough to prevent drying of the fluid. On the other hand, for proper functioning of the device, it is important that the orifice be cleared by very light pressure upon the point. The latter is a desirable feature because it often happens that the only backing, or support, for the paper during a correction operation is the hand of the operator.

Thus, constructions given to security of the fluid are usually too difficult to operate, while those that are easy to operate suffer from drying of the fluid reservoir.

SUMMARY OF THE INVENTION

It is, therefore, an object of the present invention to provide a correction fluid dispenser having a secure seal at the orifice during periods of non-use and an easily opened orifice during periods of use.

With the above and other objects in view, as will hereinafter appear, a feature of the present invention is the provision of a correction fluid dispenser comprising a body member adapted to retain correction fluid, a barrel member received by the body member, a core portion extending axially of the body and barrel members, and a tip seal member disposed in a recess in the core portion and spring biased toward an orifice in the barrel member to block the orifice and prevent flow of fluid therethrough, the tip seal member being retractable against the spring bias to permit fluid flow through the orifice, the body and barrel members being operable to move the core portion, and thereby the tip seal member, into the orifice in blocking, nonretractable position.

An especially important feature of the invention resides in the fact that the tip seal member is adapted to rotate with the body member thereby assuring that as the tip seal member is moved forward into sealing relationship wit the orifice in the barrel member, there will occur a wiping action to aid in the removal of particulate material or fluid residue which might otherwise result in a non-fluid-tight seal permitting leakage of correction fluid or premature failure due to dry-out.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention from which its novel features and advantages will be apparent.

In the drawings.

DESCRIPTION OF THE PREFERRED EMBODIMENTS

Figure 1:
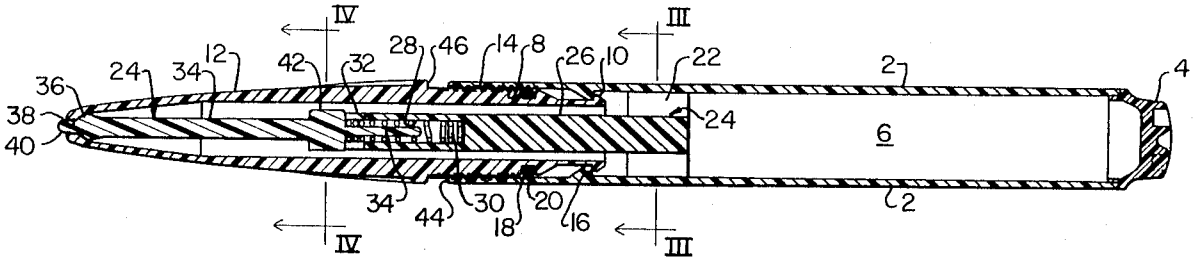
FIG. 1 is a centerline sectional view of one form of dispenser illustrative of an embodiment of the invention.

Referring to FIG. 1, it will be seen that an illustrative example of the invention includes a tubular body member 2 closed at one end by a cap member 4 and adapted to provide a reservoir 6 for correction fluid.

Near the end of the body member 2, removed from the cap member 4, the body member is provided with an internal first connector means, which in the illustrative example, is in the form of screw threads 8. The body member 2 is also provided with inwardly-extending shoulder means 10.

The device further includes a barrel member 12, which is generally conically shaped in a forward position thereof, with the remainder thereof generally tubular. The barrel member 12 is provided with a second connector means, illustrated in the form of external threads 14, threadedly engaged with the body member internal threads 8. The barrel member 12 is accordingly in part disposed within the body member 2 and is provided with outwardly directed flange means 16 engageable with the shoulder means 10.

The barrel member 12 further may be provided with an O-ring 18 disposed in a circular recess 20, the O-ring abutting the interior of the body member 2.

Disposed in the interior of the body member 2, by way of internal struts 22 is an elongated axially disposed core portion 24 which extends centrally of the body and barrel members 2, 12.

The core portion 24 includes a base portion 26 which is provided with an axial recess 28 in which is disposed a spring means, preferably a coil spring 30. The base portion 26 of the core portion 24, in the area of the recess 28, is provided with a pair of open-ended slots 32.

The core portion 24 further includes a tip seal member 34, a first end of which comprises a seal portion 36 adapted to block an orifice 38 in the barrel member 12, and a tip portion 40 which extends into and through the orifice. A second end of the tip seal member 34 extends telescopically into the recess 28. The tip seal member is provided with wing portions 42, extending from either side of the member 34, which ride in the slots 32 and receive one end of the coil spring 30, the spring thus urging the tip seal member toward the orifice 38.

In operation, the interior of the body and barrel members 2, 12 may be filled with correction fluid, the O-ring 18 preventing leakage at the juncture of the body and barrel members, and the tip seal member 34 and spring 30 preventing leakage at the orifice 38.

In the position shown in FIG. 1, the body and barrel members 2, 12 have been threadedly moved to a first position in which the shoulder and flange means 10, 16 are engaged and the open end 44 of the body member 2 is separated from an annular shoulder 46 on the barrel member 12. In such position. the tip seal is urged by the spring 30 to a position in which the orifice 38 is blocked by the tip portion 40 and seal portion 36 of the tip seal member, but is retractable against the bias of the spring to open the orifice 38 to permit flow of fluid therethrough.

When correction is desired, the body and barrel members are rotated to the position shown in FIG. 1, and the tip portion is pressed against the surface on which the correction is to be made. The spring 30 is of relatively weak force, permitting ready retraction of the tip seal member 34.

Figure 2:
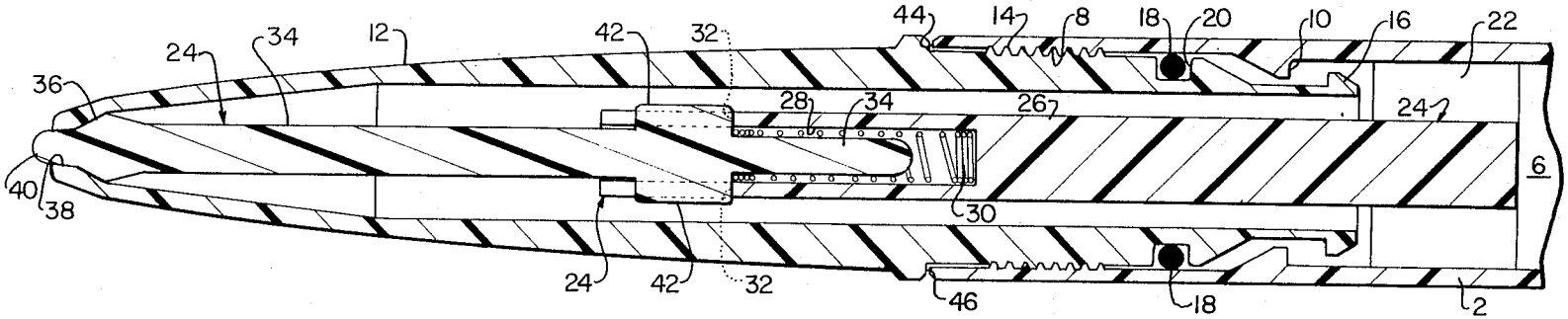
FIG. 2 is a sectional view, similar to FIG. 1, but showing the parts in a different position.
Figure 3:
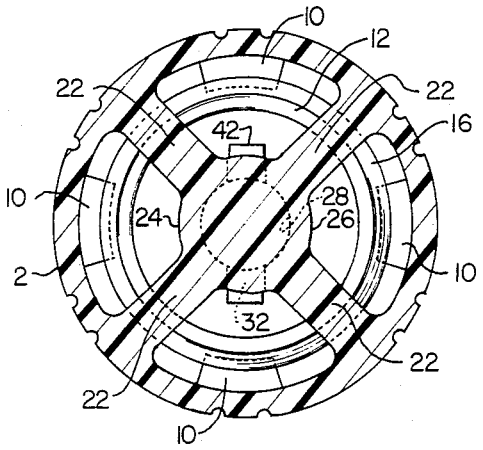
FIG. 3 is a sectional view of the device, taken along line III—III of FIG. 1.
Figure 4:
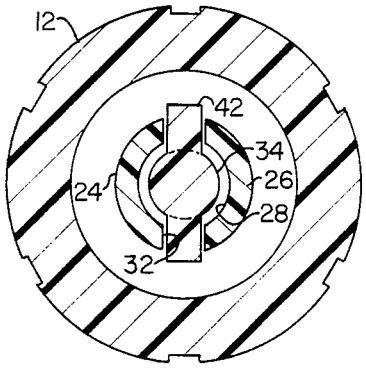
FIG. 4 is a sectional view taken along line IV—IV of FIG. 1.

After use, the body and barrel members are rotatively moved to the position shown in FIG. 2, wherein the shoulder and flange means 10, 16 are separated and the open end 44 of the body member 2 is proximate the annular shoulder 46 of the barrel member 12.

In the second position, shown in FIG. 2, the closed ends of the slots 32 engage the wing portions 42 on the tip seal member 34, limiting telescopic movement and forcing the tip portion 40 and the seal portion 36 into blocking position in and around the orifice 38, to prevent entry of air into the device seal portion 36 and the contact surface of orifice 38 being rotated with respect to each other as they make contact to aid in the removal of particulate material or fluid residue which might otherwise result in a non-fluid-tight seal. In the second position, the tip seal member is firmly engaged with the orifice 38 and is nonretractable.

Referring to FIGS. 5–8, there is illustrated another embodiment of the invention in which the axial movement of seal portion 36 is brought about by the cooperation of a pair of radially projecting pins coacting with cam slots as will be hereinafter described.

In the embodiment illustrated in FIGS. 5–8, core portion 24 is rotationally fixed with respect to tubular body member 2 by the coaction of wing portions 50 and key ways 52 formed by ribs 48.

Figure 5:
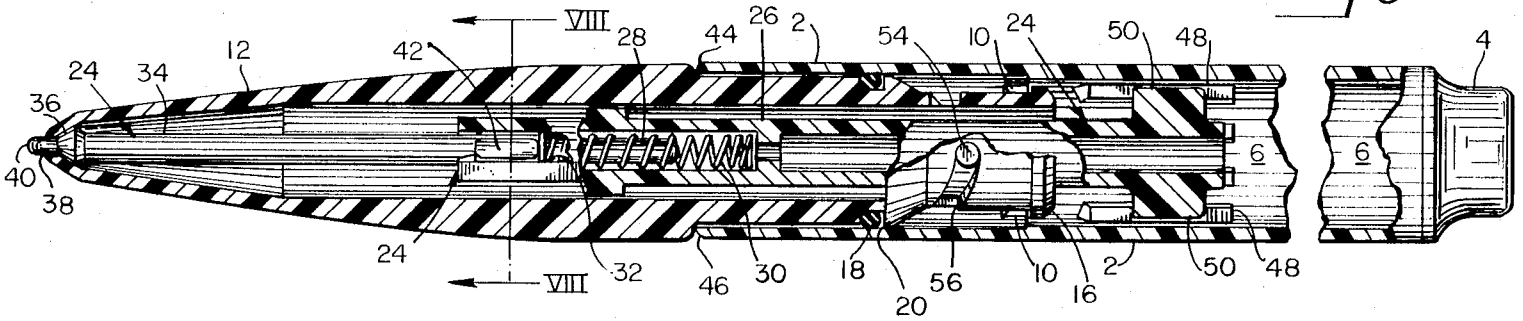
FIG. 5 is a centerline sectional view of another form of dispenser illustrative of an embodiment of the invention.
Figure 7:
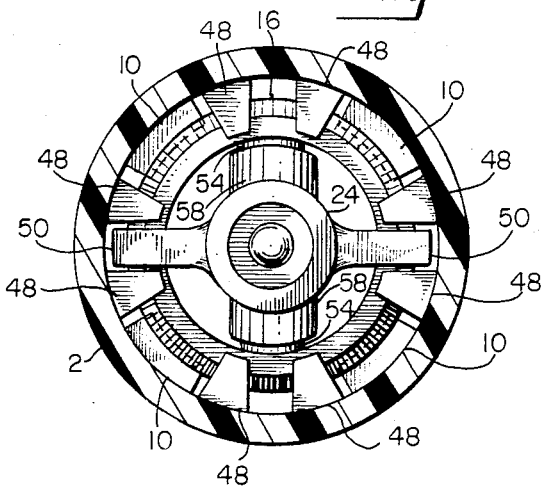
FIG. 7 is a sectional view of the device taken along line VII—VII of FIG. 6.
Figure 8:
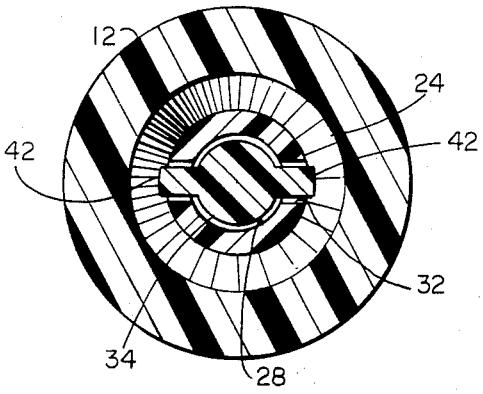
FIG. 8 is a sectional view taken along line VIII—VIII of FIG. 5.

In the position shown in FIG. 5, the body and barrel members 2, 12 have been rotated to a relative position in which the tip seal is urged by the spring 30 to a position in which the orifice 38 is blocked by the tip portion 40 and seal portion 36 of the tip seal member, but is retractable against the bias of the spring to open the orifice 38 to permit flow of fluid therethrough.

When correction is desired, the body and barrel members are rotated to the position shown in FIG. 5, and the tip portion is pressed against the surface on which the correction is to be made. The spring 30 is of relatively weak force, permitting ready retraction of the tip seal member 34.

Figure 6:
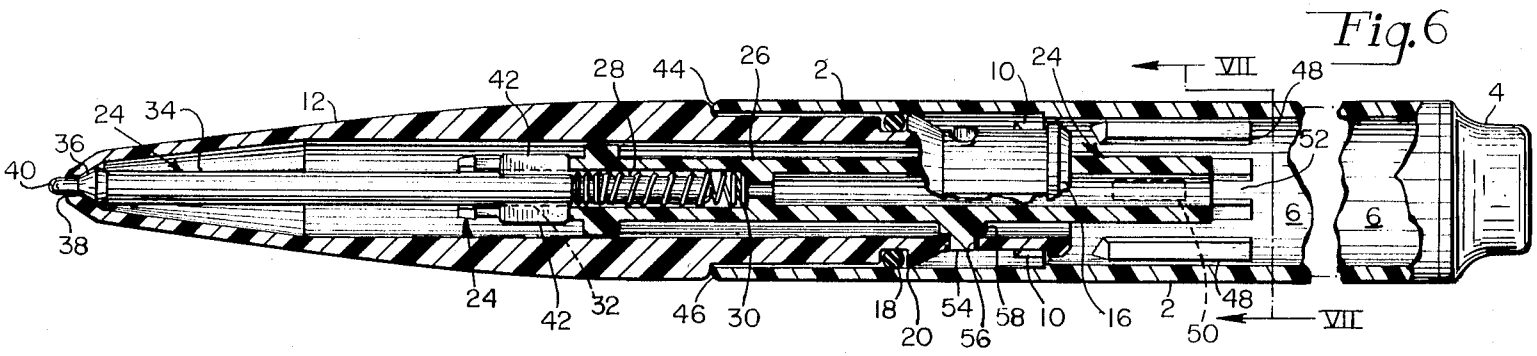
FIG. 6 is a sectional view similar to FIG. 5 but showing the parts in a different position.

After use, the body and barrel members are rotatively moved in a clockwise direction to the position shown in FIG. 6. During rotation, radially projecting pins 54, mounted upon pin bases 58, bear upon the walls of angled cam slots 56 to convert the rotational movement of barrel member 12 to forwardly axial movement of core portion 24. Relative rotation between core portion 24 and body member 2 is prevented by the coaction of wing portions 50 and key ways 52 formed by ribs 48. As tip seal member 34 moves forward to advance seal portion 36 toward the contact surface of orifice 38, the relative rotation of tip seal member 34 and orifice 38 results in a wiping action to aid in the removal of particulate material or fluid residue which might otherwise result in a non-fluid-tight seal.

In the second position shown in FIG. 6, the closed ends of slot 32 engage the wing portions 42 on the tip seal member 34, limiting telescopic movement and forcing the tip portion 40 and the seal portion 36 into blocking position in and around the orifice 38, to prevent leakage or entry of air into the device as described above. In the second position, the tip seal member is firmly engaged with the orifice 38 and is non-retractable.

The axial force required to overcome the biasing action of spring means 30 can be controlled by the choice of spring which is employed. Where it is intended to use the correction fluid dispenser of this invention in correcting mistakes made during the typing process, I prefer to employ a spring, the biasing force of which can be overcome by the application of an axially directed force against tip portion 40 of about two to five grams. By using a spring having such characteristics, corrections may be made upon surfaces which are relatively unsupported such as the portion of a sheet of paper in a typewriter immediately above the platen. Where corrections are to be made on material which is fully supported, such as lying flat on a desk top, there may be employed springs requiring substantially more than two to five grams of force to overcome their biasing force.

Since the correction fluid composition employed in conjunction with the dispenser of this invention will come in contact with the various parts, it is important that materials of construction be chosen to minimize chemical or solvent interactions. This is especially important when organic solvent-based correction fluids are to be employed in a dispenser assembled from plastic parts. Where it is intended, for example, to employ correction fluids containing trichloroethane or trichloroethylene, all of the parts are preferably made from one or more of the various moldable nylon polymers. To minimize chemical reaction with the material of spring 30, I prefer that it be made from stainless steel.

It is to be understood that the present invention is by no means limited to the particular construction herein disclosed and/or shown in the drawings, but also comprises any modifications or equivalents within the scope of the disclosure.

I claim:

1. A correction fluid dispenser comprising a body member adapted to retain a correction fluid, a barrel member engaged with said body member, a core portion extending axially of said body member and said barrel member, a tip seal member telescopically engaged with said core portion, and a spring means disposed between said core portion and said tip seal member, said body member and said barrel member being relatively rotatable to a first position in which said tip seal member is spring biased toward an orifice in said barrel member to retractably block said orifice to prevent flow of said fluid therethrough unless the spring bias is overcome and a second position in which said core portion is moved axially to its telescopic limit to force said tip seal member against said orifice to prevent retraction of said tip seal member, said core portion and said tip seal member being adapted to rotate with said body member and relative to said barrel member and orifice to provide a wiping action to aid in the removal of particulate material or fluid residue.

2. A correction fluid dispenser as described in claim 1 in which said barrel member and said body member are engaged by means of a set of cooperating threads.

3. A correction fluid dispenser as described in claim 1 in which said barrel member and said body member are engaged by means of cooperating shoulder and flange means.

4. A correction fluid dispenser as described in claim 1 in which the movement of said core portion results from the engagement of cooperating cam slot means and pin means.

5. A correction fluid dispenser as described in claim 1 in which the force necessary to retract said tip seal member against said spring bias is from about two to about five grams.

6. A correction fluid dispenser as described in claim 1 in which said body member and said barrel member are made from a moldable nylon polymer.

7. A correction fluid dispenser comprising a body member adapted to retain a correction fluid, a barrel member engaged by means of cooperating shoulder and flange means with said body member, a core portion extending axially of said body member and said barrel member, a coil spring disposed within said core portion and a tip seal member engaged with said core portion and spring biased toward an orifice in said barrel member to retractably block said orifice to prevent flow of said fluid therethrough, said tip seal member being retractable against said spring bias by the application of a force of about two to about five grams to provide flow of said fluid through said orifice, said barrel member and core portion having co-operating cam slot means and pin means to move said core portion in response to relative rotation of said body member and said barrel member thereby moving said tip seal member into said orifice in nonretractable blocking position, said core portion and said tip seal member being adapted to rotate with said body member, said dispenser being constructed of a moldable nylon polymer and containing an organic solvent-based correction fluid.

* * * * *